US005513753A

United States Patent [19]

Jensen

[11] Patent Number: 5,513,753

[45] Date of Patent: May 7, 1996

[54] TOP CARRIER FOR GABLE CARTONS

[75] Inventor: Kurt D. Jensen, Walden, N.Y.

[73] Assignee: International Paper, Purchase, N.Y.

[21] Appl. No.: 336,121

[22] Filed: Nov. 4, 1994

[51] Int. Cl.[6] ..... B65D 73/00

[52] U.S. Cl. ..... 206/431; 294/87.2

[58] Field of Search ..... 206/427, 431, 206/434; 229/117.14, 120.01; 294/87.2, 87.28

[56] References Cited

U.S. PATENT DOCUMENTS

| | | | |
|---|---|---|---|
| 2,514,858 | 7/1950 | Gray . | |
| 2,675,264 | 4/1954 | Lugt . | |
| 2,696,401 | 12/1954 | Church . | |
| 2,713,508 | 7/1955 | Austin . | |
| 3,221,876 | 12/1965 | Currie . | |
| 3,829,143 | 8/1974 | Bird . | |
| 3,900,103 | 8/1975 | Day . | |
| 4,441,611 | 4/1984 | Sommariva | 206/431 |
| 5,267,644 | 12/1993 | Tsao | 229/117.14 X |

*Primary Examiner*—Jacob K. Ackun
*Attorney, Agent, or Firm*—Michael J. Doyle

[57] ABSTRACT

A carton carrier fashioned from a unitary blank of paperboard displays utility in carrying two or more cartons of the cable top type. The carrier is in the general form of an inverted rectangular tray, with the longitudinal side walls of the tray having double thickness tongues which fit into end recesses of respective gable top cartons, such as milk cartons. The carrier may be carried by placing fingers inside an opening on its top surface. The construction permits vertical stacking of groups of gable top cartons and also provides sufficient strength for carrying the cartons.

6 Claims, 2 Drawing Sheets

TOP CARRIER FOR GABLE CARTONS

BACKGROUND OF THE INVENTION

This invention relates to a carrier for gable top type paperboard cartons, such as, milk and juice type cartons. Gable top cartons have received wide acceptance and are common in food stores. It sometimes occurs that it is desired to carry two or more gable top cartons of, typically, one-half gallon capacity. Unless a paper or plastic bag is used, it is inconvenient to transport them.

In order to overcome these difficulties, it is already known in the paperboard container art to provide a carrier for carrying two or more gable top type paperboard cartons, such a construction being shown in U.S. Pat. No. 2,514,858 issued to Gray. In the Gray construction, a carton carrier is so constructed that it has an upwardly extending fin with a hand hole therein. The two sides of the carrier diverge at approximately 90° with respect to each other and are provided with respective openings, oppositely pairwise matched, each opening including a tongue which fits into a recess beneath the slanted main roof panels of each carton. While this construction has apparently performed adequately, it has the drawback of being higher than desirable. Further, it is not possible to vertically stack groups of gable top cartons secured together by the carrier of Gray. Further, the single thickness tongue at each end of each of the gable top cartons could, in some circumstances, break or deform to thereby impair the carrying capability of the carrier.

SUMMARY OF THE INVENTION

According to the practice of this invention, a gable top carton carrier is fashioned from a unitary blank of paperboard or other stiff, foldable and resilient sheet material. The paperboard is cut and scored and is folded into a generally inverted tray configuration. Pairwise openings along the longitudinal sides of the inverted tray are provided with supporting tongues or flaps which are received by the gable top cartons beneath their main roof panels and beneath the usual longitudinally extending top fin on each carton. The top of the carrier of this invention is flat and is provided with an opening to define a finger hold for carrying the cartons. The construction is simple and permits stacking of several groups of gable top cartons, such as those filled with milk or fruit juice. The tongues or flaps in the longitudinal side walls are of double thickness to thereby yield added strength to the carrier.

DETAILED DESCRIPTION OF THE INVENTION

Figure 1:
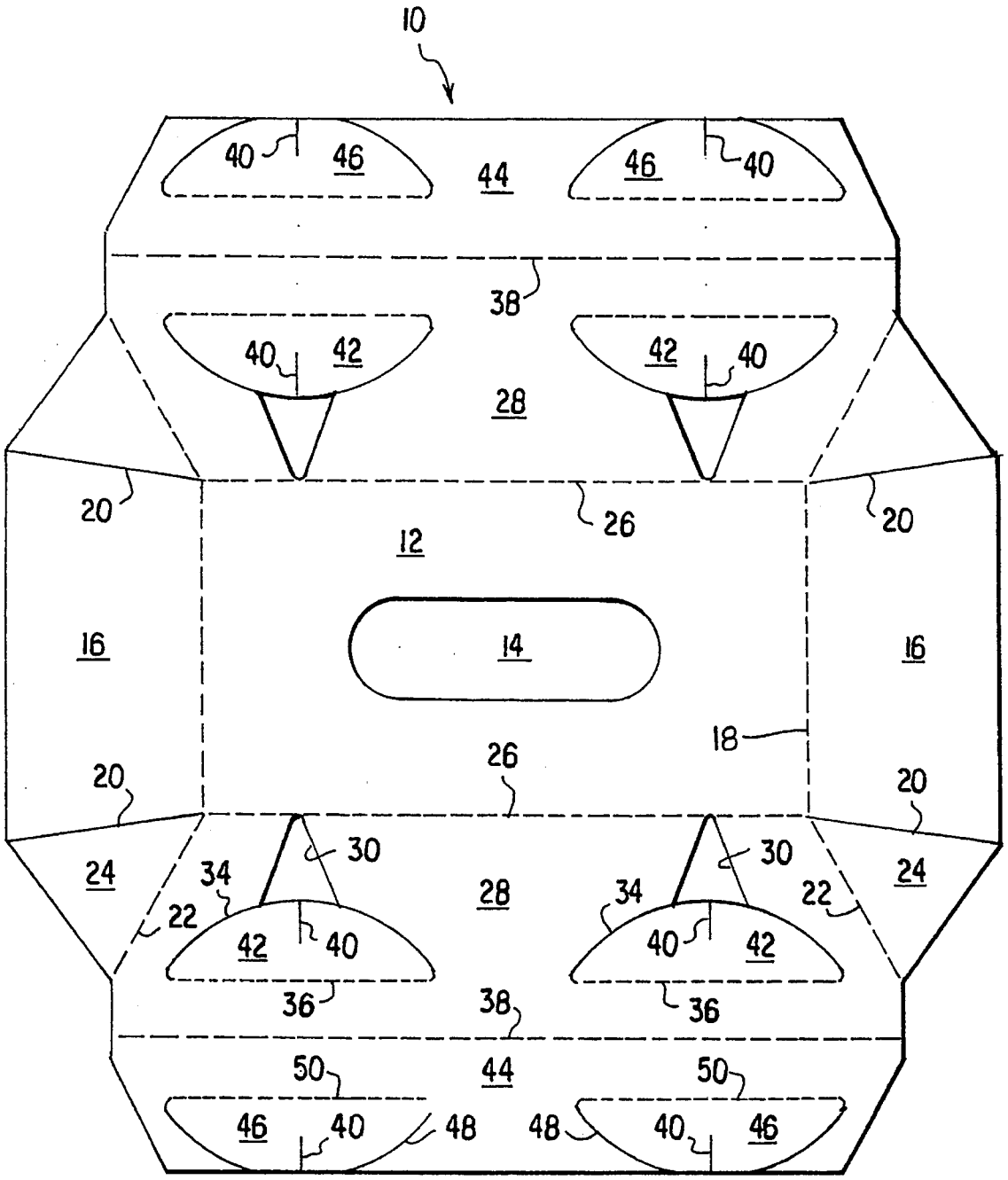
FIG. 1 is a plan view of a unitary blank of paperboard from which the carton carrier of this invention is fashioned.

Referring now to FIG. 1 of the drawings, a unitary blank of paperboard is designated as 10 and includes a main or central panel 12 having a generally oval opening 14 centrally thereof and running generally parallel with the longitudinal sides of panel 12. Two end panels are each designated as 16, each defined by cut lines 20 and fold lines 18.

Fold lines 22 and cut lines 20 define triangular glue flaps 24. Fold lines 26, bordering longitudinal edges of main panel 12, foldably secure each of two innermost longitudinal side walls 28 to main panel 12. In turn, each innermost longitudinal side wall 28 is provided with triangular cutouts 30, with an apex of each tangent to a respective fold line 26. Arcuate cuts 34 are also provided in each side wall 28, with the base of each generally triangular cutout 30 being coincident with a free edge portion of each arcuate cut 34. Fold lines 36 communicate at each end thereof with respective ends of cut lines 34. Cuts 34 and fold lines 36 define respective inner tongues 42, the central portions of which have a cut line 40 extending to a free tongue edge thereof.

Fold lines 38 run parallel to the longitudinal direction of each side wall 28, with the outermost longitudinal edges of innermost side walls or panels 28 foldably carrying outermost longitudinal side walls or panels each designated as 44. Outer tongues 46 are defined by arcuate cut lines 48 and fold lines 50 which join the ends of cut lines 48. Outer tongues 46 also carry cut lines 40 extending to the free portions of these tongues where they are substantially tangent to the longitudinal free edges of panels 44. It is seen that pairs of tongues 42, 46 which are opposite sides of fold lines 38 are longitudinally spaced along the blank.

Figure 2:
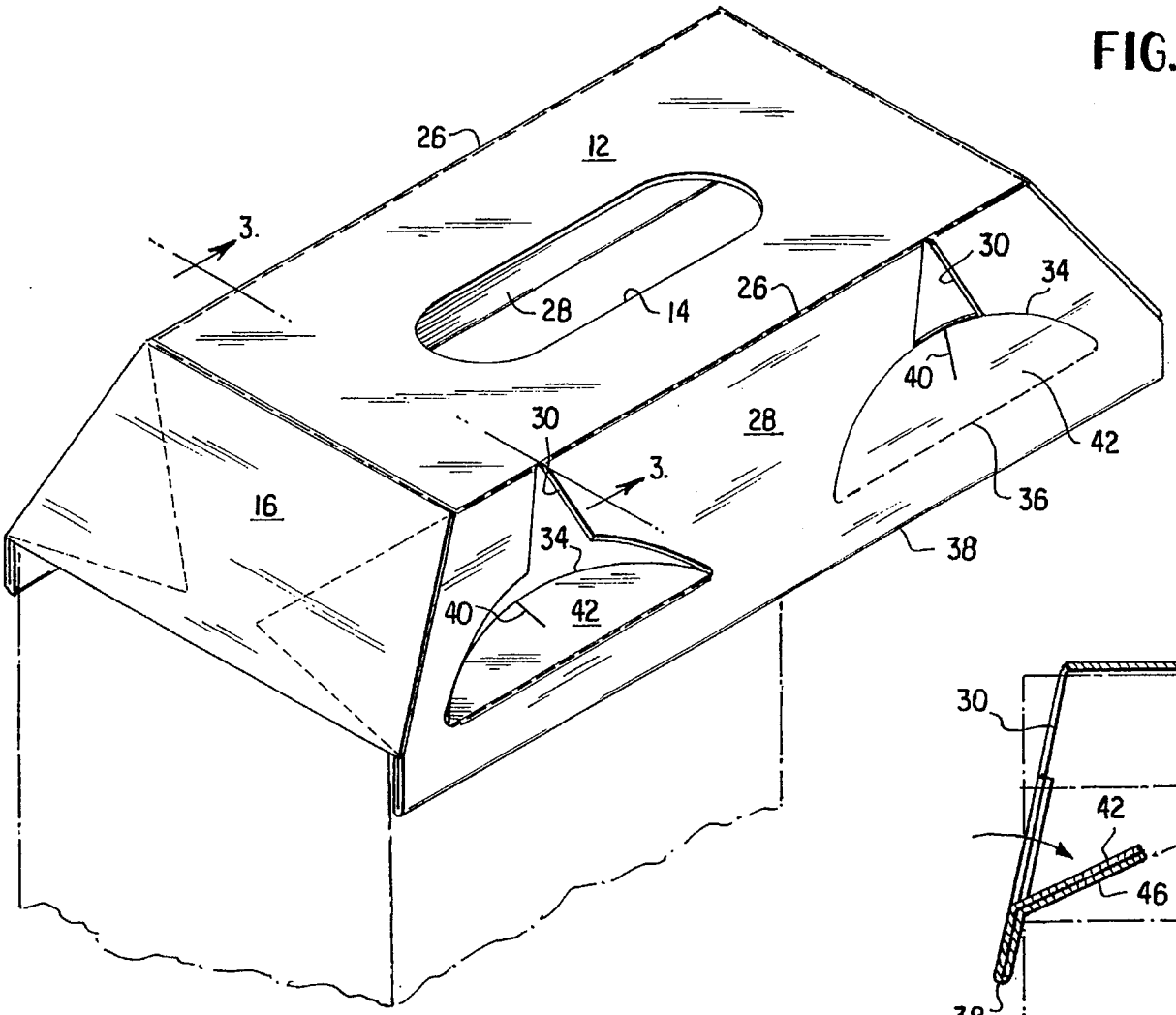
FIG. 2 is a perspective view showing the blank of FIG. 1 folded and glued to form the carrier of this invention.
Figure 3:
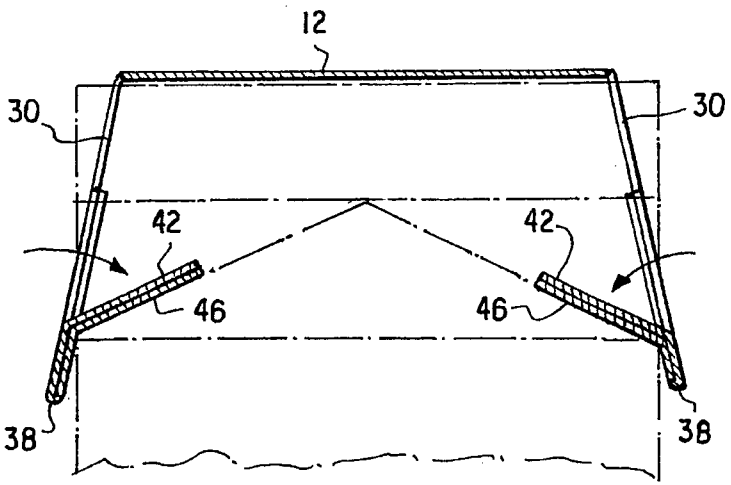
FIG. 3 is a view taken along section 3—3 of FIG. 2.

Referring now to FIGS. 2 and 3, the blank of FIG. 1 has been folded about its respective fold lines and glued so as to form a generally inverted tray. Triangular flaps 24, carried by respective side walls 28, are glued to the interior portions of end walls 16, as indicated by the dashed lines at FIG. 2. Outermost side walls 44 are folded about their respective fold lines 38, with outermost side wall 44 glued to innermost side wall 28. The arrangement is such that opposite pairs of tongues 42 and 46 of innermost and outermost side walls 28 and 44 are superposed and in registry to form one double thickness tongue for each end recess of each gable top carton. This may be seen at FIG. 3. The carrier is now ready to accept a plurality of gable top cartons, one being shown in phantom lines at FIGS. 2 and 3. It is seen that double thickness tongues defined by 42 and 46 extend into the ends of a respective gable top carton, beneath the usual longitudinally running fin on each such carton, and beneath the main roof panels of the carton. Main panel 12 contacts the upper edges of the longitudinally running fins at the top of each gable top carton. This construction thus permits stable vertical stacking of several groups of cartons, one on top of the other, an action not possible with the construction of the noted Gray patent. FIG. 2 illustrates the function of generally triangular openings 30, namely, to receive the ends of the fins of the gable top cartons. The function of cuts 40 in each of the tongues is to provide some tongue flexibility in positioning themselves when lifting the cartons.

If desired, outer side walls 44 are first folded about lines 38 and glued to side walls 28 after the blanks 10 are cut, scored and formed. Then, after the gable top carton packager receives the substantially flat carriers, glue flaps 24 are glued to end walls 16 to thus erect the carrier to its final three dimensional form.

In use, a consumer places fingers inside opening 14 and lifts upwardly. This causes the carrier to move upwardly with respect to the cartons, with the double thickness tongues 42 and 46, which are pairwise opposite to each other for any given carton, engaging the lower surfaces of the ends of the slanting main roof panels of a respective gable carton.

I claim:

1. A unitary paperboard blank for forming a carrier for gable top type paperboard cartons, said blank including a main, central and generally rectangular panel, a pair of end wall forming panels foldably secured to respective ends of said main panel, a pair of foldably joined innermost and outermost longitudinal side wall panels foldably secured to respective longitudinal sides of said main panel along respective said innermost side wall panels, each said outermost side wall panel having an outer pair of tongues longitudinally spaced from each other, each said outer tongue defined by a fold line and an arcuate cut line, each said innermost longitudinal side wall panel having a first pair of longitudinally spaced inner tongues, each of said inner tongues defined by an arcuate cut line and a fold line.

2. The carrier blank of claim 1 wherein said outer tongues each have a central portion which is substantially tangent to a respective longitudinal free edge of said outermost longitudinal side wall panel.

3. The carrier blank of claim 1 including a fin end receiving opening between each said inner tongue and said main panel.

4. A carton carrier fashioned from a unitary blank of paperboard and adapted to carry a plurality of gable top type paperboard cartons, said carrier being in the general form of an inverted rectangular tray having longitudinal side walls and transverse end walls and a central, main bottom panel, each of said longitudinal side walls having at least a pair of longitudinally spaced tongues, said tongues being inwardly bendable towards opposite tongues of said tray about respective fold lines, each said tongue being of a double thickness of said paperboard.

5. The carrier of claim 4 wherein each of said tongues is provided with a slot substantially centrally thereof.

6. The carton carrier of claim 4 wherein each of said longitudinal side walls is provided with a fin end receiving opening, and wherein one portion of each of said fin end receiving openings is substantially tangent to a longitudinal edge of said main panel, said fin end receiving openings being located above and longitudinally aligned with respective said tongues.

* * * * *